US005257430A

United States Patent [19]

Yamaguchi

[11] Patent Number: 5,257,430

[45] Date of Patent: Nov. 2, 1993

[54] BED HAVING A SYSTEM FOR MOVING A MATTRESS UP AND DOWN

[76] Inventor: Yoshihisa Yamaguchi, 3-17, Kitakoiwa 7-chome, Edogawa-ku, Tokyo, Japan

[21] Appl. No.: 965,885

[22] Filed: Oct. 23, 1992

[30] Foreign Application Priority Data

Feb. 28, 1992 [JP] Japan ..... 4-044064

[51] Int. Cl.[5] ..... A47C 21/00; A47C 21/06

[52] U.S. Cl. ..... 5/659; 5/454; 5/488; 254/93 HP

[58] Field of Search ..... 5/659, 660, 615, 453, 5/455, 449, 454, 488; 254/93 HP

[56] References Cited

U.S. PATENT DOCUMENTS

| | | | |
|---|---|---|---|
| 1,772,310 | 8/1930 | Hart | 5/615 |
| 3,026,541 | 3/1962 | Murat | 254/93 HP |
| 3,717,885 | 2/1973 | De Mare | 5/660 |
| 4,697,290 | 10/1987 | Ackind et al. | 5/455 |
| 4,719,685 | 1/1988 | Anderson | 254/93 HP |
| 4,807,313 | 2/1989 | Ryder et al. | 5/660 |

FOREIGN PATENT DOCUMENTS

| | | | |
|---|---|---|---|
| 2373996 | 12/1976 | France | 5/451 |
| 3207308 | 9/1990 | Japan | 5/615 |

*Primary Examiner*—Alexander Grosz

*Attorney, Agent, or Firm*—Thompson, Hine and Flory

[57] ABSTRACT

This invention relates to a bed having a base, a mattress, and a system for moving the mattress up and down to help a person to make the bed, which can be preferably adapted in a guest room of hotels or the like. The present invention provides a bed comprising a base, a mattress provided on a top face of the base, at least one inflatable means provided therebetween, and an air-supplying tube connected with a part of the inflatable means, wherein the inflatable means has a plurality of inflatable parts and a plurality of non-inflatable parts, each non-inflatable part is alternatively provided between the inflatable parts so as to communicate to each other to make a loop around an outer peripheral portion of the top face of the base.

6 Claims, 12 Drawing Sheets

BED HAVING A SYSTEM FOR MOVING A MATTRESS UP AND DOWN

BACKGROUND OF THE INVENTION

1. Field of the Invention

This invention relates to a bed having a base, a mattress, and a system for moving the mattress up and down to help a person to make the bed, which can be preferably adapted in a guest room of hotels or the like.

2. Description of the Prior Art

Making the bed is one of the routine jobs for a person in charge of fixing the guest rooms in the hotels, in which the person spreads bed-clothes such as sheets and blankets over the mattress and lifts the mattress with one hand to put the corners of the bed-clothes under the mattress. The person must repeat these steps over and over within a little time to make a lot of beds. Therefore a system for helping the person for making the bed has been needed.

FIG. 14 shows one of the conventional bed having the helping system disclosed in a document of Japanese patent application (TOKKAI-HEI-3-207308). This bed 1 comprises a base 2, a mattress 3, and an inflatable body 4 provided between the base 2 and the mattress 3. As shown in the figure, the inflatable body 4 is a square-shaped elastic bag which can be connected with an air supplying means 6 through tubes 5, 7 and a valve 8. These tubes 5, 7 form a passage of compressed air-flow from the air-supplying means 6, while the valve 8 provided between the above tubes 5, 7 is responsible to block or permit the air-flow to the inflatable body 4.

Generally, the air supplying means 6 is an air-supply tube connected to an air compressor, a gas cylinder or the like for supplying a large amount of compressed air to the inflatable body 4. In the figure, however, only one end of the air-supply tube is shown.

The above conventional system is used as follows:

(i) firstly, connecting one end of the air-supplying tube 7 with the air-supplying means 6, and also connecting the other end of the air-supplying tube 7 with the air-introducing tube 5 of the inflatable body 4 through the valve 8 to introduce the compressed air into the body 4;

opening the valve 8 to allow the compressed air to the inflatable body 4;

filling the inflatable body 4 with a supply of the compressed air for lifting the mattress to make a space between the base 2 and the mattress 3;

closing the valve 8 to stop the compressed air flow to the inflatable body 4 and simultaneously to avoid an out flow of the air therefrom;

putting the corners of the bed-clothes 9 spread over the mattress 3 under the mattress 3; and opening the valve 8 to release the air from the inflatable body 4 to move down the mattress 3, resulting that the corners of the bed-clothes 9 are placed between the mattress 3 and the base 2.

In this way, the above system helps the person who makes the bed.

As described above, however, the conventional system requires a large amount of compressed air from the air-supplying means 6 connected to the air compressor or the like to fill the inflatable body 4. Thus it is difficult to provide the hotel with air-supplying means to supply the compressed air to each guest room when the installation of the above conventional system is demanded.

SUMMARY OF THE INVENTION

An object of the invention is to provide a bed comprising at least one inflatable means having a plurality of inflatable parts and a plurality of non-inflatable parts both provided between a base and a mattress. Each non-inflatable part is localized in alternate inflatable parts so as to communicate with each other to make a loop around an outer peripheral portion of the top face of the base. The inflatable means is connected to an air-supplying means to obtain a supply of compressed air.

According to one of the embodiments of the present invention, the inflatable parts has a bulbous shape, while the non-inflatable parts has a tubular shape.

According to another embodiment of the present invention, the inflatable means is a generally closed circular tube having a plurality of portions as inflatable parts and a plurality of covered surface portions with short sleeves as non-inflatable parts.

According to a further embodiment of the present invention, the inflatable means is a generally O-shaped air bag having selectively sealed areas as non-inflatable parts.

It is preferable that the inflatable means are divided into two independent parts, i.e., one part is laid on one side of the top surface of the base, while the other part is laid on the other side of the top surface of the base. In this case, each part is independently connected to the air-supplying means.

It is also preferable that the air-supplying means is a foot pump, but not limited to.

The above and other related objects and features of the invention will be apparent from reading of the following description of the disclosure found in the accompanying drawings and the novelty thereof pointed out in the appended claims.

BRIEF DESCRIPTION OF THE DRAWINGS

In order that the invention may be readily carried into effect it will now be described with reference to the accompanying drawings, wherein:

DESCRIPTION OF THE PREFERRED EMBODIMENTS (1) A bed having an inflating means characterized by its globular inflating portions FIGS. 1 to 3 shows one of the embodiments in accordance with the present invention. In these figures, a bed 11 comprises a base 12, a mattress 13 provided on a top face 12A of the base 12, a inflatable means 15 provided between the base 12 and the mattress 13, and an air-supplying tube 18 connected with a part of the inflatable means 15.

Figure 1:
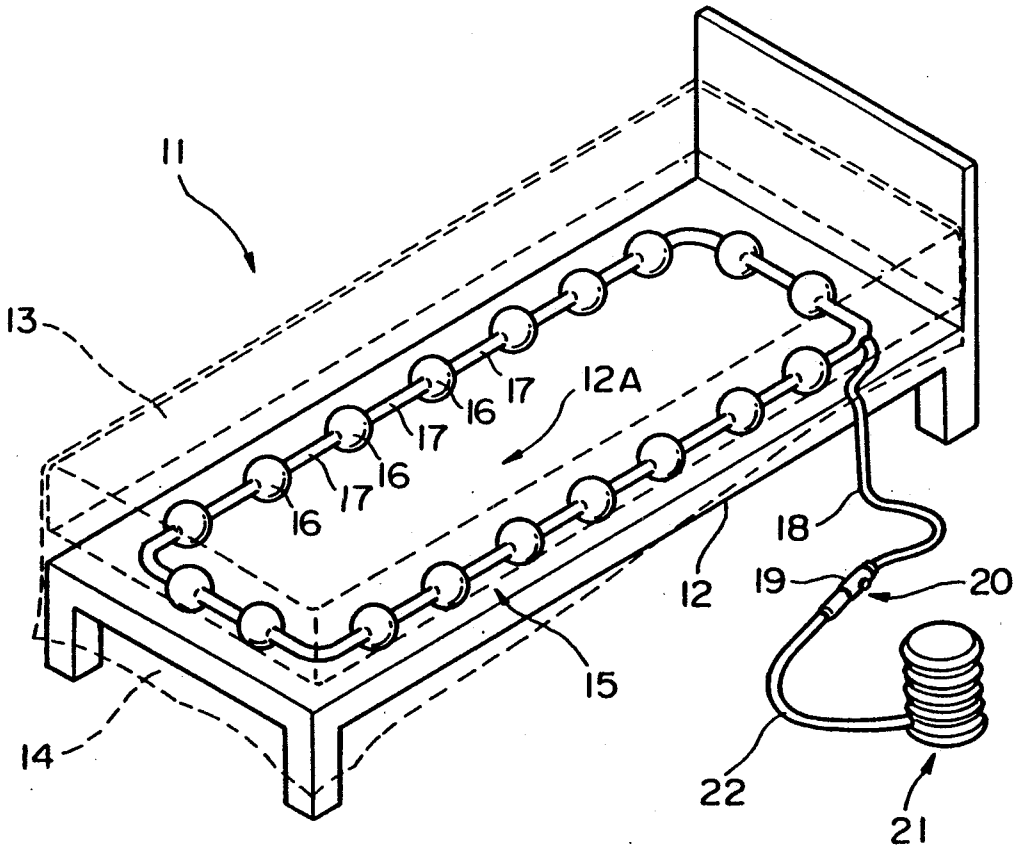
FIG. 1 is a view of an embodiment of the bed having a system of moving the mattress up and down in accordance with the present invention.

The inflatable means 15 is made of a plasto-elastic material such as vinyl chloride, synthetic rubber or the like. This means 15 comprises a plurality of bulbous parts 16 having a comparatively thin layer for inflating with a supply of compressed air and a plurality of tubular parts 17 having a comparatively thick layer for maintaining its size against the air flow. In this embodiment, each tubular part 17 is alternatively connected with the bulbous parts so as to communicate each other. Therefore the inflatable means 15 is provided as a loop around an outer peripheral portion of the top face 12A of the base 12.

The air-supplying tube 18 has a free end which can be adapted to one end of a connector 20 having a non-return valve 19.

In this embodiment, the compressed air is supplied from a portable foot pump 21 having an outlet tube 22 adaptable to the other end of the connector 20. Therefore the air-supplying tube 18 can be connected with the pump 21 through the connector 20.

When the compressed air is supplied from the pump 21, the globular parts 16 fill out and the mattress 13 is lifted up from the base 12. When the compressed air is not supplied from the pump 21 or blocked by the connector 20, on the other hand, the globular parts 16 is flattened by a weight of the mattress 13.

Figure 2:
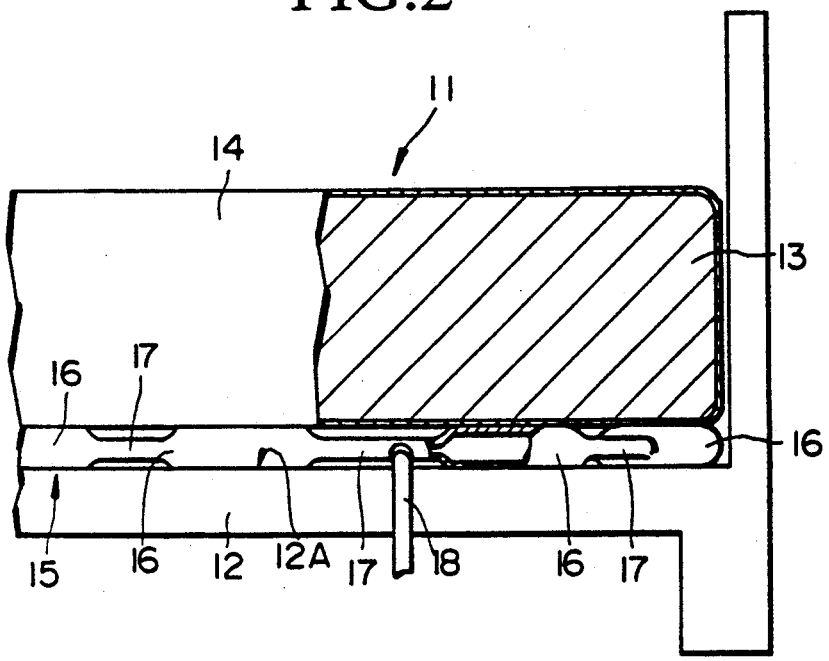
FIG. 2 is a partially schematic sectional view showing the system of FIG. 1 in the non-operating condition.
Figure 3:
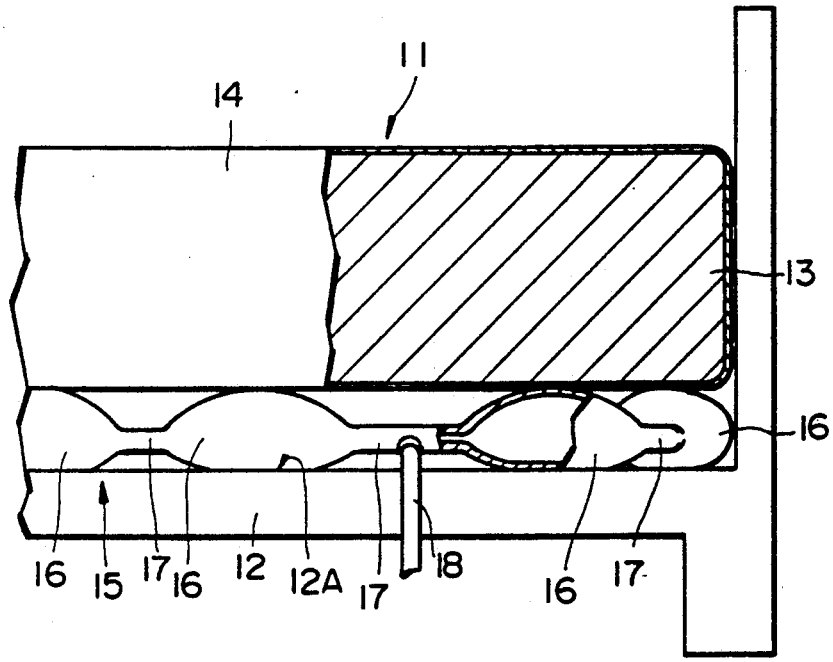
FIG. 3 is a partially schematic sectional view showing the system of FIG. 1 in the operating condition.

A process of making a bed using the above system in accordance with the first embodiment of the present invention is as follows (see FIGS. 2 and 3):

(i) connecting the tube 18 with the foot pump 21 through the connector 20 to supply the compressed air to the inflatable body 15:

(ii) filling the bulbous parts 16 of the inflatable body 15 with the compressed air by stepping on the foot pump 21 to move up the mattress 13 to make a space between the mattress 13 and the base 12;

(iii) stopping the air supply from the foot pump 21, in this case a backward flow of the air is not occurred because of the non-return valve 19 of the connector 20;

(iv) making the bed by turning down the corners of bed-clothes 14 spread over the mattress 13 and putting these corners under the mattress 13; and (v) opening the valve 19 to release the air from the inflatable body 15 to move down the mattress 13, resulting that the corners of the bed-clothes are placed between the mattress 13 and the base 12.

Figure 4:
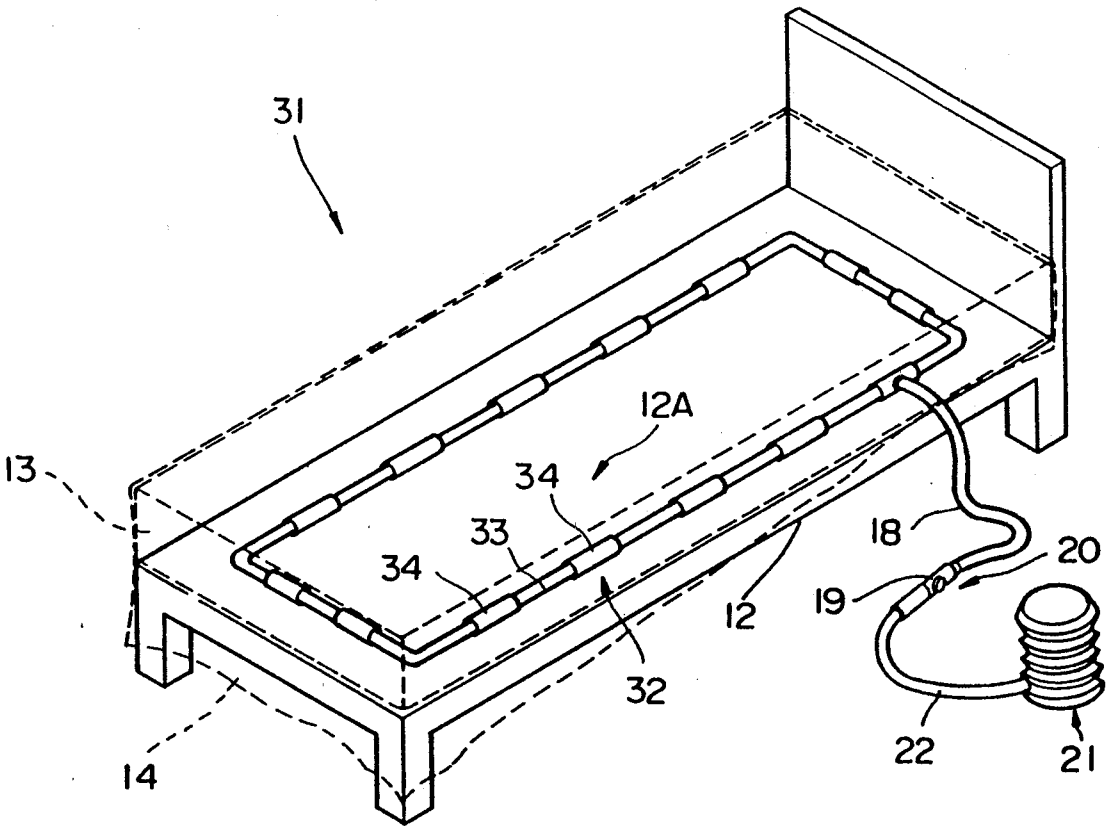
FIG. 4 is a view of a second embodiment of the bed having a system of moving the mattress up and down in accordance with the present invention. In this figure, the system is in a non-operating condition.
Figure 5:
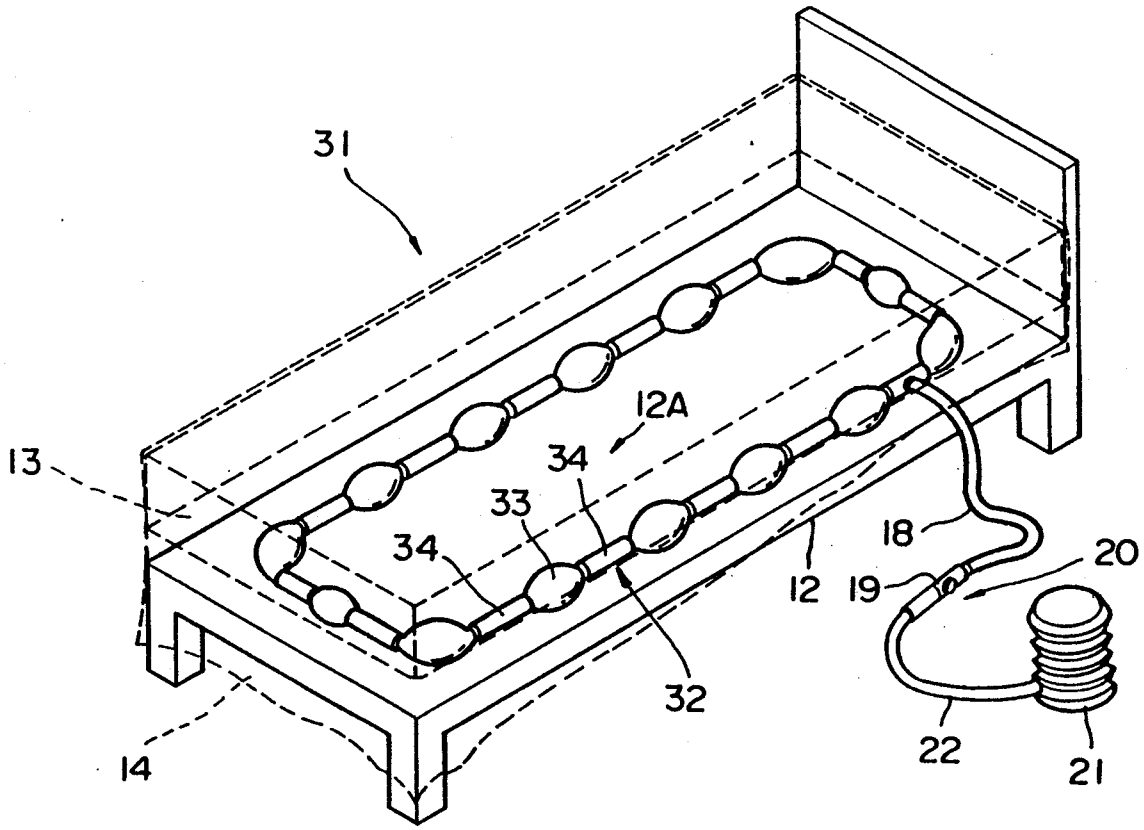
FIG. 5 is a view of the second embodiment of the bed having the system of FIG. 4 in an operating condition.
Figure 6:
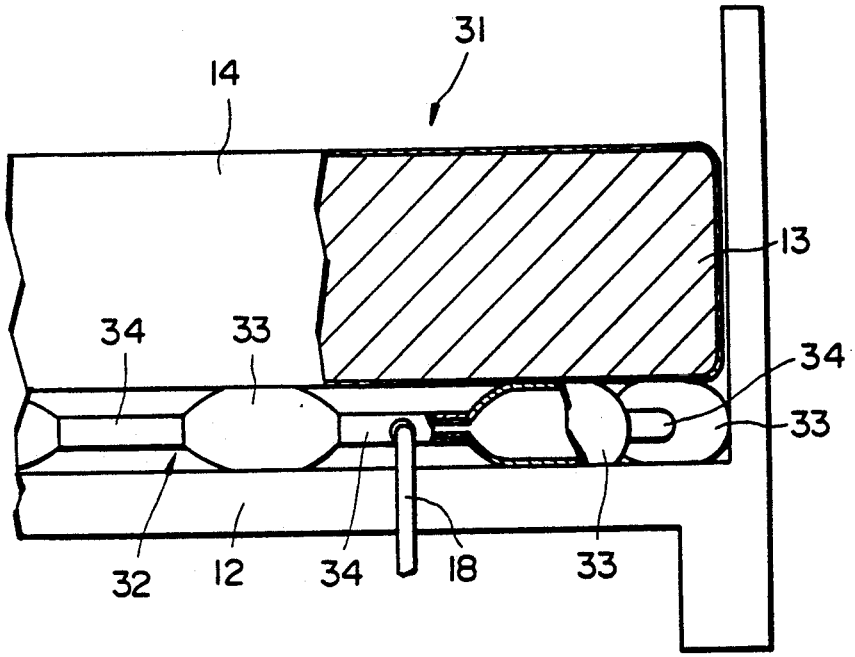
FIG. 6 is a partially schematic sectional view showing the system of FIG. 4, in which the system is in the operating condition.

(2) A bed having an inflating means characterized by its tubular inflating portions FIGS. 4 to 6 shows a bed of another embodiment in accordance with the present invention which is the as same as that of the first embodiment except for an inflatable means 22.

In this embodiment, the inflatable means 33 is a closed circular tube made of a plasto-elastic material such as vinyl chloride, synthetic rubber or the like. The tube 33 is provided as a loop around an outer peripheral portion of the top face 12A of the base 12 and is partially covered with a plurality of short sleeves 34 of a hard material such as a metal, a hard resin or the like. These sleeves 34 are spaced with each other at regular intervals on the tube 33 to make inflatable portions of the tube 33 between the sleeves 34. These inflatable portions can be filled by a supplying compressed air, while sleeve-covered portions are not.

In this embodiment, the compressed air is supplied from a portable foot pump 21 which is a same one as used in the first embodiment.

A process of making a bed using a system in accordance with the second embodiment of the present invention is as follows (see FIGS. 5 and 6):

(i) connecting the tube 18 with the foot pump 21 through the connector 20 to supply the compressed air to the inflatable body 15;

(ii) filling the inflatable portions 33 of the body with the compressed air by stepping on the foot pump 21 to lift the mattress 13 up;

(iii) stopping the air supply from the foot pump 21 and putting the corners of the bed-clothes under the mattress 13; and (iv) opening the valve 19 to release the air from the inflatable portions 33 to move down the mattress, resulting that the corner of the sheet is placed between the mattress 13 and the base 12.

Figure 7:
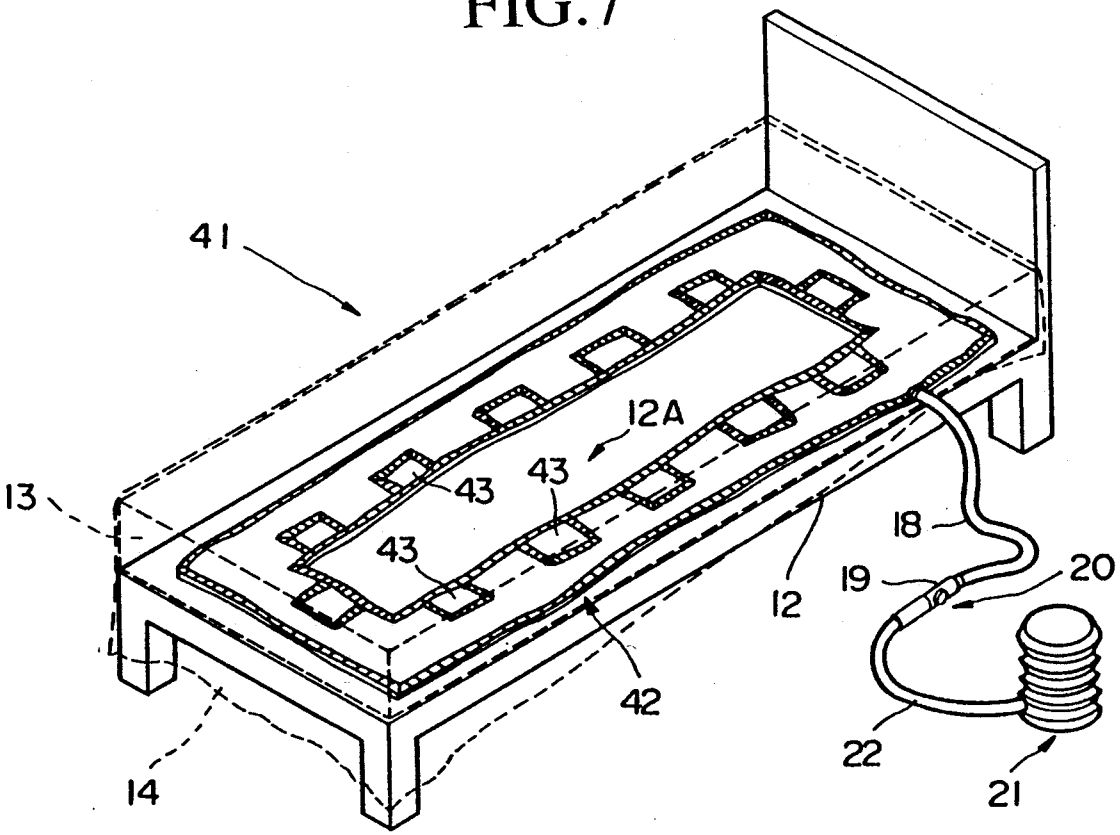
FIG. 7 is a view of a third embodiment of the bed having a system of moving the mattress up and down in accordance with the present invention, in which the system is in a non-operating condition.
Figure 8:
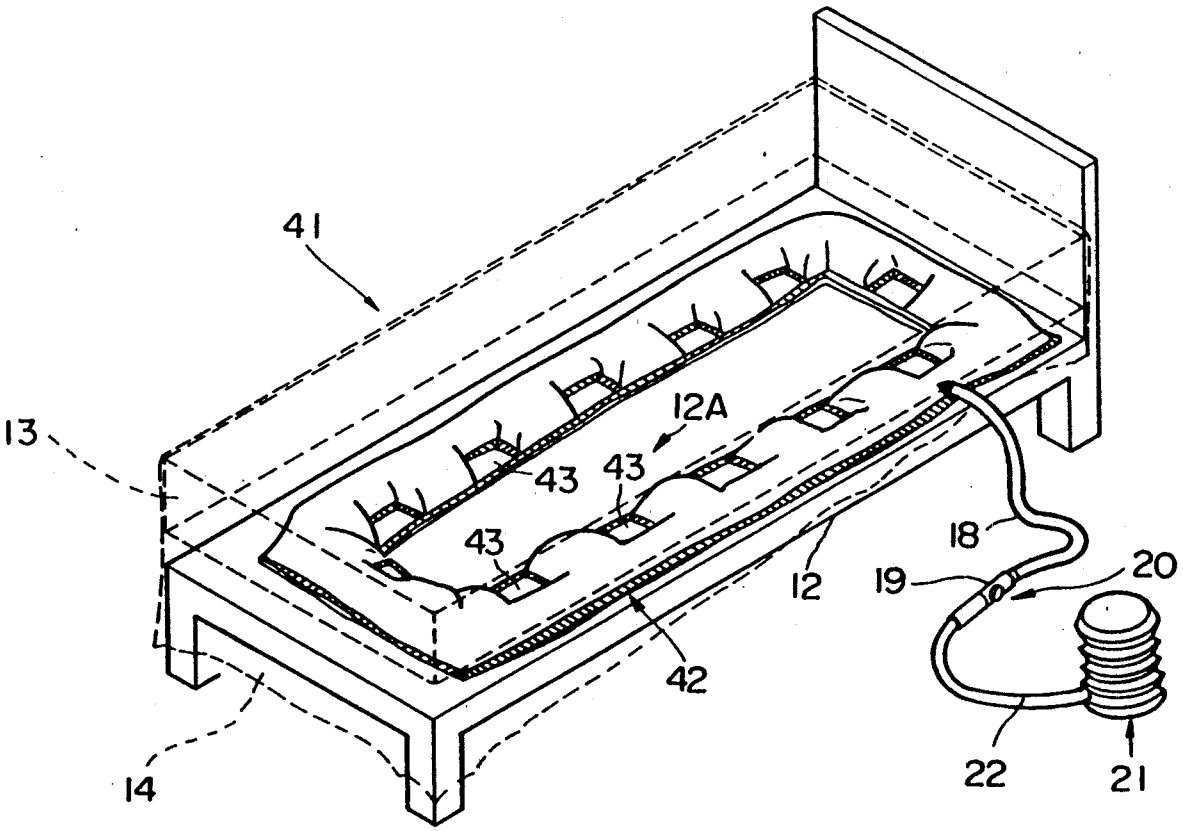
FIG. 8 is a view of the third embodiment of the bed having the system of FIG. 7, in which the system is in an operating condition.
Figure 9:
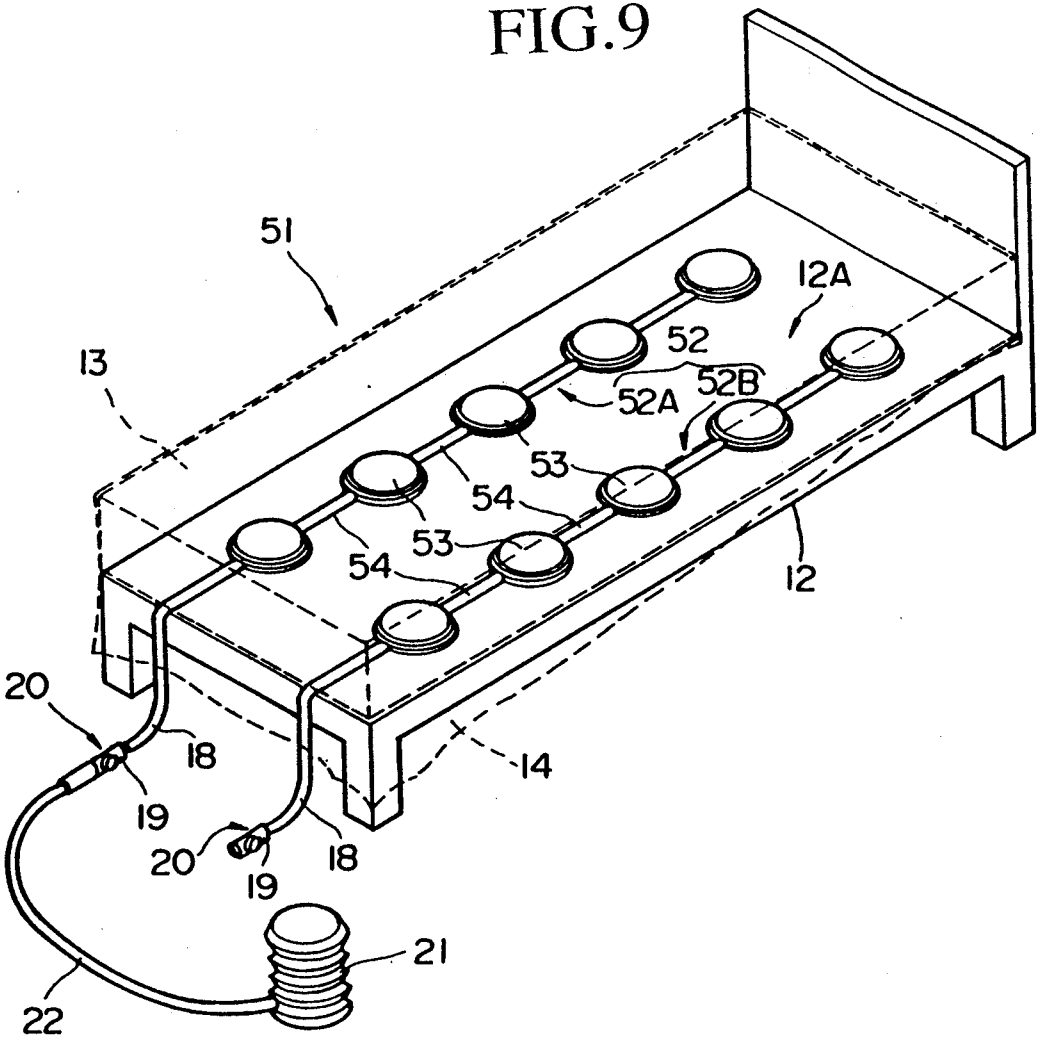
FIG. 9 is a view of a fourth embodiment of the bed having a system of moving the mattress up and down in accordance with the present invention, in which the system is in a non-operating condition.
Figure 10:
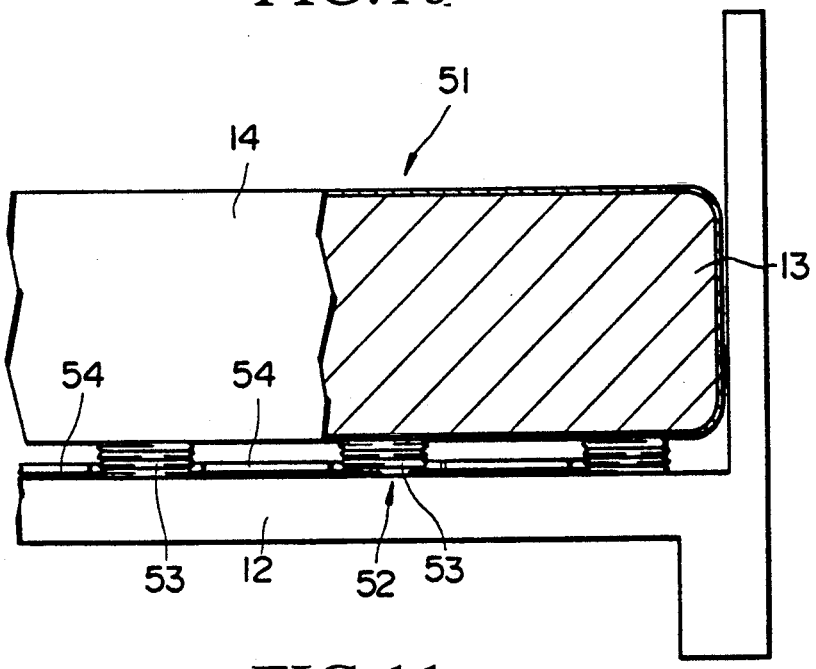
FIG. 10 is a partially schematic sectional view showing the system of FIG. 9 in the non-operating condition.
Figure 11:
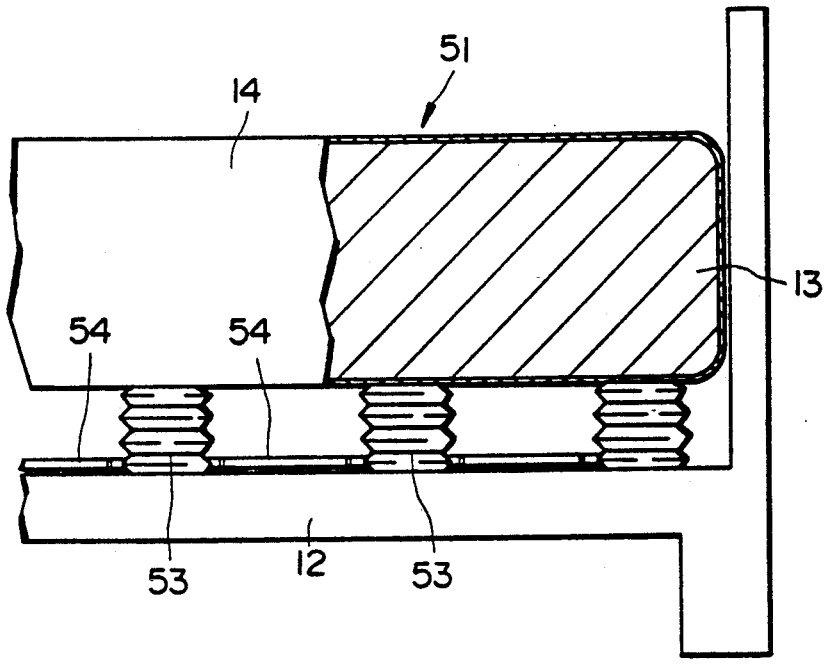
FIG. 11 is a partially schematic sectional view showing the system of FIG. 9 in the operating condition.
Figure 12:
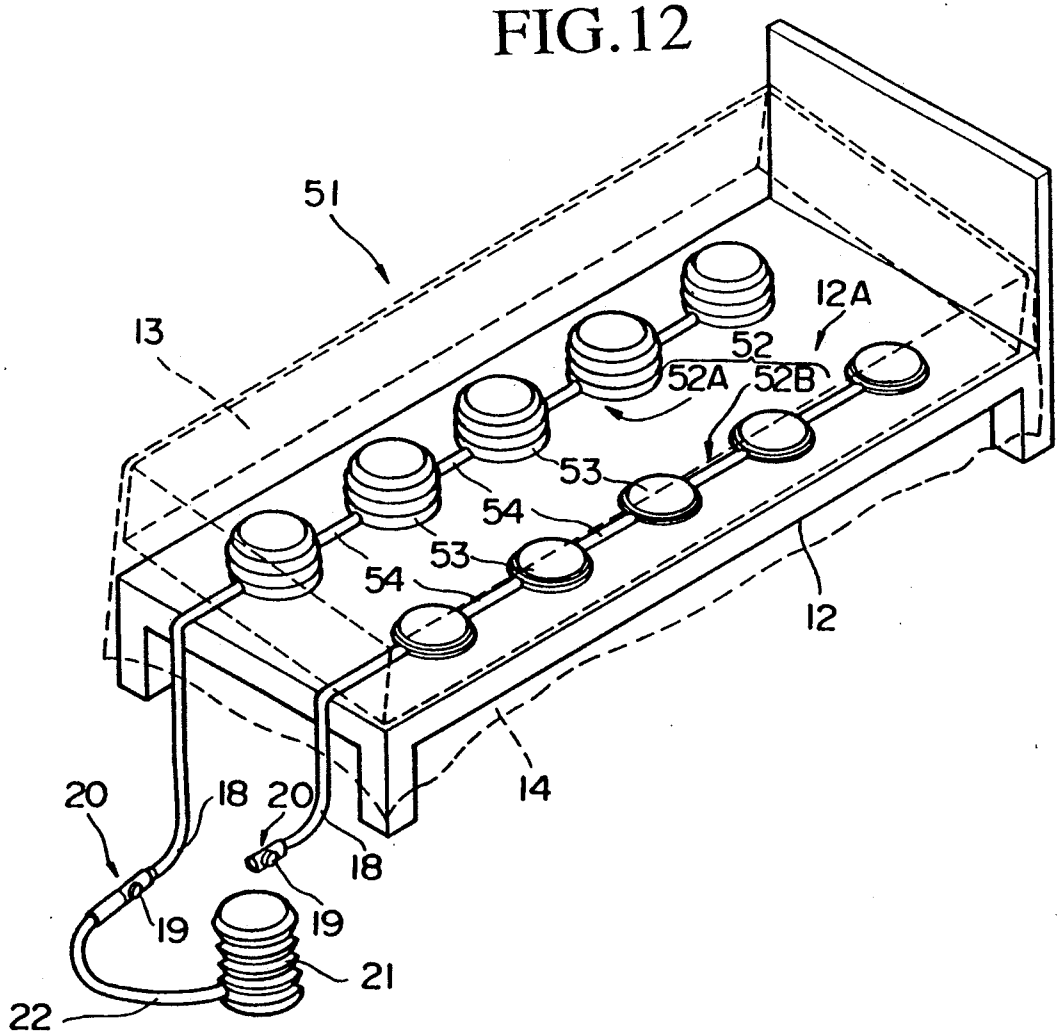
FIG. 12 is a view of the bed having the system of FIG. 9, in which the system is in another operating condition.
Figure 13:
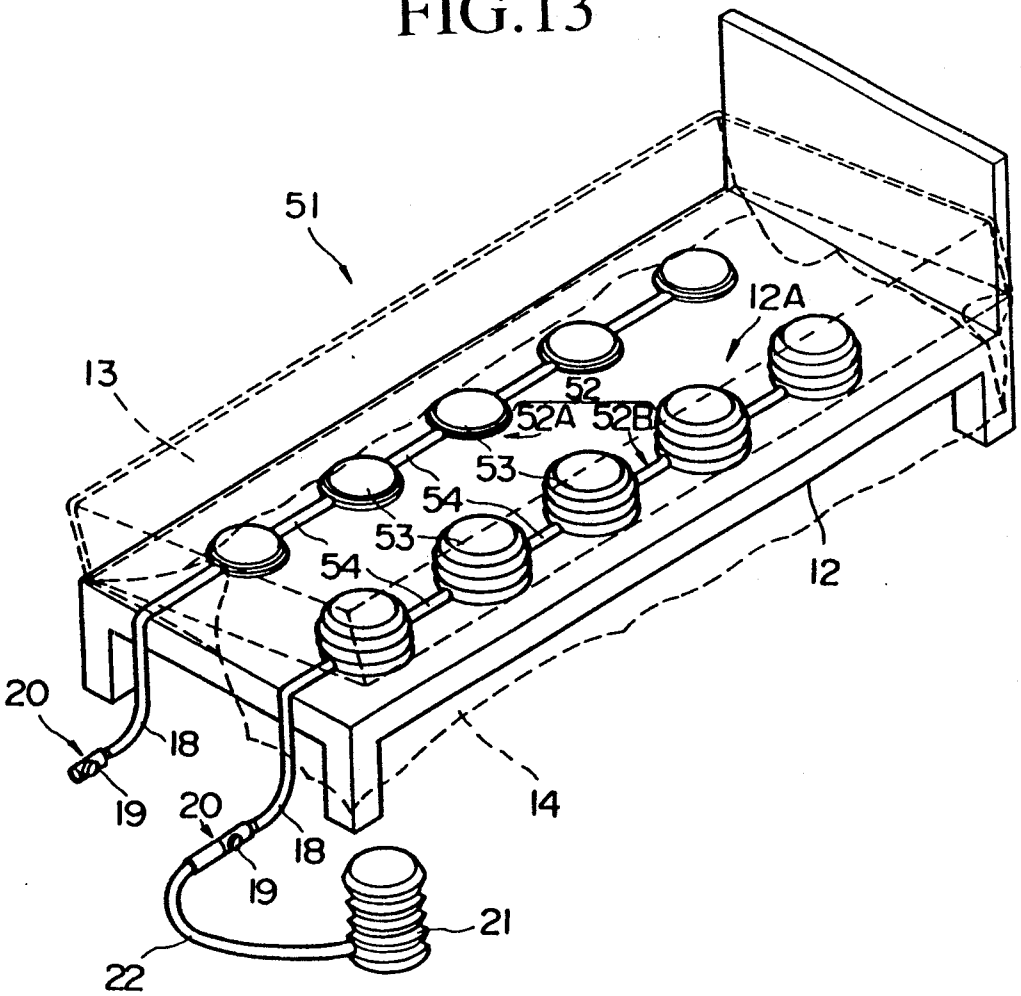
FIG. 13 is a view of the bed having the system of FIG. 9, in which the system is in still another operating condition.
Figure 14:
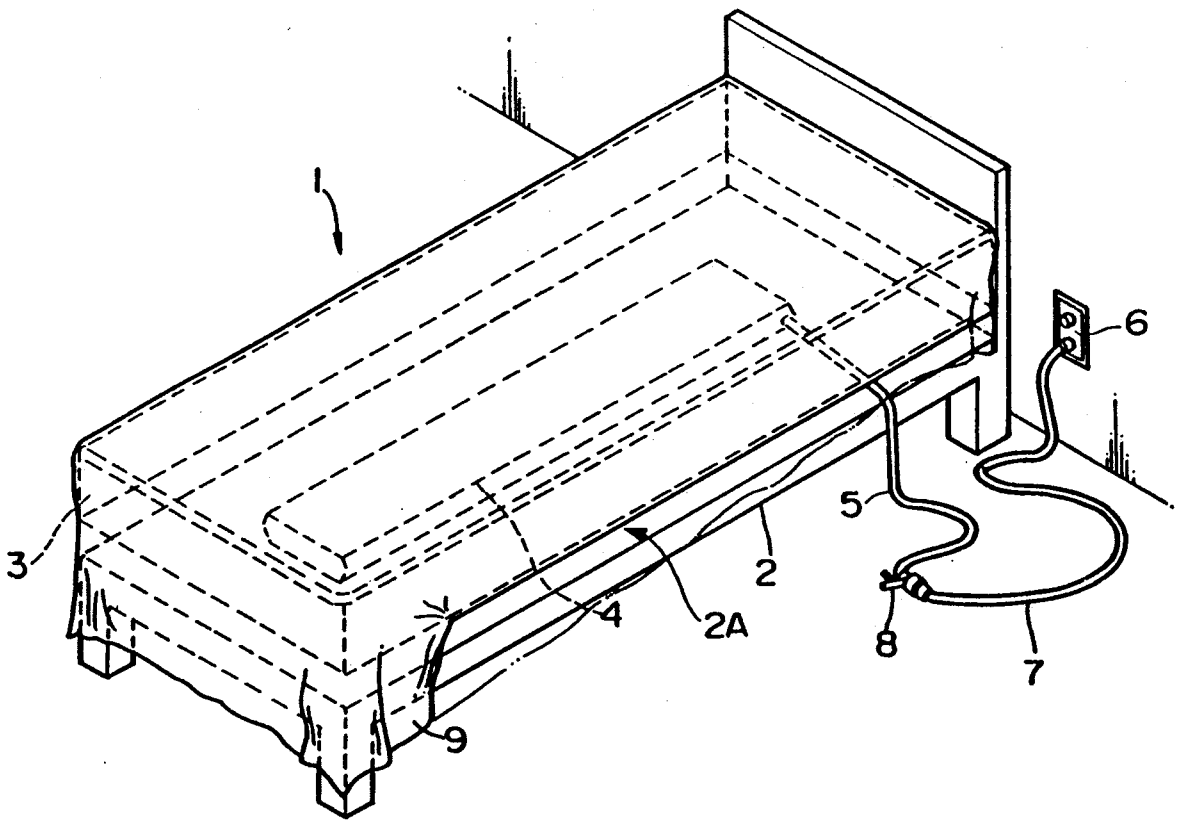
FIG. 14 (PRIOR ART)
FIG. 14 is a view of the bed having the conventional system of moving the mattress up and down.

(3) A bed having an inflating means characterized by its O-shaped inflating portion FIGS. 7 and 8 shows a third embodiment in accordance with the present invention, which is the same as one of the first and second embodiments, except that an inflatable means 42 is in the form of a generally "O"-shaped air bag to make a loop around an outer peripheral portion of the top face 12A of the base 12.

The inflatable means 33 is made of two fixed plasto-elastic sheets such as vinyl chloride sheets, synthetic rubber sheets or the like and is sealed in selected areas to make a non-inflatable portions 43 at regular interval.

In this embodiment, the compressed air is supplied from a portable foot pump as in the first embodiment.

A process of making a bed using a system in accordance with the third embodiment of the present invention is as follows (see FIGS. 7 and 8);

(i) connecting the tube 18 with the foot pump 21 through the connector 20 to supply the compressed air to the inflatable means 42;

(ii) filling up the inflatable portion of the bag 42 with the compressed air by stepping on the foot pump 21;

(iii) making the bed after lifting the mattress up; and (iv) opening the valve 19 to release the air from the inflatable means 42 to move down the mattress.

(4) A bed having an inflating means including two different inflating systems

FIGS. 9 to 13 show another embodiment of the present invention. In this embodiment, the inflatable means are separated into first and second inflatable systems 52A, 52B. One system is laid on one side of the top surface of the base, while the other system is laid on the other side of thereof. Each system is independently connected to the air-supplying means, so that it is possible to inflate only one system to lift the one side of the mattress (see FIG. 12).

The inflatable means 52 having two expanding systems 52A, 52B which are made of a plasto-elastic material such as vinyl chloride, synthetic rubber or the like. Each system comprises a plurality of inflatable parts 53 and a plurality of non-inflatable tubular parts 54. In this embodiment, each tubular part 17 is provided between the inflatable parts 53 so as to communicate each other.

In this embodiment, the systems 52A, 52B are connected with air-supplying tubes 18, respectively. Each tube 18 can be connected with the pump 21 through a connector 20 having a non-return valve 19. That is, one end of the air-supplying tube 18 is connected with one of the tubular parts 17, while the other end of thereof is connected with the connector 20.

When the air is not supplied from the pump 21, the inflatable parts 53 are flattened by a weight of the mattress 13 and the mattress 13 is laid on the base 12. On the other hand, when the air is supplied from the pump 21, the inflatable parts 53 are filled up and the mattress become separate from the base.

A process of making a bed using the above systems is as follows:

(i) connecting the tube 18 with the foot pump 21 through the connector 20 to supply the compressed air to the inflatable body 15;

(ii) filling up the fist system 52A or the second system 52B with the compressed air by stepping the foot pump 21 to lift up the mattress to make a space between the mattress and the base;

(iii) stopping the air supply from the foot pump (in this case, a backward flow of the air is not caused by the non-return valve 19 of the connector 20);

(iv) making the bed by turning down the corners of sheets and blankets spread over the mattress and putting them under the mattress;

(v) opening the valve 19 to release the air from the inflatable body 15 to move down the mattress 13, resulting that the corners of the bed-clothes are placed between the mattress 13 and the base 12; and then (vi) filling up the second system 52B or the first system 52A and repeat the above steps of (iii)–(v).

Accordingly, the beds having inflating means in accordance with the present invention will help the person who makes the bed. Also the inflating means described in (1) to (4) do not require a large amount of the compressed air because the mattress 13 can be easily lifted up by a part of the inflating means provided around the outer peripheral portion of the top face 12A of the base 12. Therefore there is no need to use a large system such as the air compressor or the like for the supply of the compressed air, and also there is no need to re-furbish the building to provide an air-supplying tube in the wall of each guest room of the hotel.

According to the second embodiment of the present invention, the structure of the inflatable means 33 is more simple than that of the first embodiment because the former is formed by only providing the tube with the sleeves.

As described above the inflatable means 42 of the third embodiment of the present invention is only made of two sheets, so that its manufacturing cost is comparatively lower than that of the first and the second embodiments. In this embodiment, also, the flattened inflatable means is so thin that it will never affect comfort of the mattress to sleep on.

The inflatable means of the fourth embodiment of the present invention has two independent inflating systems, so that it is possible to fill one system to lift the one side of the mattress.

While there has been described what is at present considered to be preferred embodiment of the invention, it will be understood that various modifications may be made therein, and it is intended to cover in the appended claims all such modifications as fall within the true spirit and scope of the invention.

What is claimed is:

1. A bed comprising a base, a mattress provided on a top face of said base, at least one inflatable means provided therebetween, and an air-supplying tube connected with a part of said inflatable means, wherein said inflatable means has a plurality of inflatable parts and a plurality of non-inflatable parts, each non-inflatable part is alternately provided between said inflatable parts in an air supplying loop around an outer peripheral portion of said top face of the said base.

2. A bed according to claim 1, wherein said inflatable parts are in the form of a bulbous shape, while said non-inflatable parts are in the form of a tubular shape.

3. A bed according to claim 1, wherein said inflatable means is a closed circular tube having a plurality of short sleeves as said non-inflatable parts, said sleeves preventing said circular tube from expanding in the portions covered by said sleeves.

4. A bed according to claim 1, wherein said inflatable means is in the form of a generally O-shaped air bag having areas therein sealed from said inflatable means so as to from non-inflatable areas in said mattress.

5. A bed according to claim 1, wherein said bed has two inflatable means, with one inflatable means laid on one side of the top surface of said base, while the other part thereof is laid on the other side of the top surface of said base, and each inflatable means is independently connected to the air-supplying means.

6. A bed according to claim 1, wherein said air-supplying means is a foot pump.

* * * * *